US006561439B1

(12) United States Patent
Bonzer

(10) Patent No.: US 6,561,439 B1
(45) Date of Patent: May 13, 2003

(54) DUAL CLOSURE NOZZLE

(76) Inventor: Robert L. Bonzer, 905 W. Amity Rd., Boise, ID (US) 83705

( * ) Notice: Subject to any disclaimer, the term of this patent is extended or adjusted under 35 U.S.C. 154(b) by 0 days.

(21) Appl. No.: 10/243,209

(22) Filed: Sep. 12, 2002

(51) Int. Cl.[7] ..... B05B 1/32
(52) U.S. Cl. ..... 239/451; 239/458
(58) Field of Search ..... 239/451–458, 239/515, 569, 570, 571

(56) References Cited

U.S. PATENT DOCUMENTS

| | | | | |
|---|---|---|---|---|
| 583,135 | A | 5/1897 | Wilson | |
| 2,331,741 | A | 10/1943 | Smith | 299/145 |
| 2,474,332 | A | 6/1949 | Sciuto | 299/131 |
| 2,560,278 | A | 7/1951 | Curtis | 299/136 |
| 3,001,725 | A | 9/1961 | Lockett | 239/458 |
| 3,494,561 | A | 2/1970 | Buehler | 239/458 |
| 3,502,270 | A | 3/1970 | Prencipe | 239/458 |
| 3,539,112 | A | 11/1970 | Thompson | 239/452 |
| 3,746,262 | A | 7/1973 | Bete et al. | 239/458 |
| 4,095,749 | A | 6/1978 | Campbell | 239/458 |
| 4,342,426 | A | 8/1982 | Gagliardo | 239/457 |
| 4,465,235 | A | 8/1984 | Allenbaugh, Jr. | 239/107 |
| 4,717,073 | A | 1/1988 | Bielka | 239/107 |
| 4,840,313 | A | 6/1989 | Hansen | 239/456 |
| 5,551,635 | A | 9/1996 | Jager | 239/240 |
| 5,556,037 | A | 9/1996 | Wood | 239/458 |
| 5,685,489 | A | 11/1997 | Larsen | 239/458 |
| 5,823,435 | A | 10/1998 | Morgan et al. | 239/107 |
| 5,833,143 | A | 11/1998 | Hsin-Fa | 239/456 |
| 6,036,117 | A | 3/2000 | Heren et al. | 239/456 |

*Primary Examiner*—Lisa A. Douglas
(74) *Attorney, Agent, or Firm*—Frank J. Dykas; Stephen M. Nipper; Derek H. Maughan

(57) ABSTRACT

A dual closure nozzle for use with a hose carrying a liquid under pressure. The dual closure nozzle is made up of an inner delivery conduit attached to an end cap and threaded within an outer sleeve. The nozzle is configured to have two different stop positions and to be adjustable between these two stop positions and a variety of open positions. When a liquid is forced through the nozzle, the flow of the liquid can then be adjusted from a first stop position, where no liquid passes out of the nozzle, through a variety of open position spray patterns to a second stop position. This configuration thus provides a nozzle that can be closed by turning the outer sleeve portion of the nozzle in either of two directions.

12 Claims, 6 Drawing Sheets

DUAL CLOSURE NOZZLE

BACKGROUND OF THE INVENTION

1. Field of the Invention

The present invention generally relates to nozzles that direct and control delivery of a material from a source, and more particularly to rotary barrel adjustable water hose nozzles that are moveable from a closed position to an open position and again to a closed position.

2. Background Information

A variety of adjustable nozzles exist that are used to control and direct the delivery of a material from a source. Liquid materials are often carried under pressure from a source through a carrier such as a hose or conduit. Many times the delivery of the liquid from the hose or conduit to an intended location is accomplished through a nozzle. Common types of nozzles include fire hose nozzles, garden nozzles, washing nozzles, and other types of nozzles. Nozzles are generally configured to perform an intended function. For example, a fire hose must be able to direct desired amounts of water in desired patterns under various pressures depending upon the specific necessities of the user. A garden hose nozzle may be configured to produce a light spray for watering delicate flowers and plants, as well as to deliver a heavier stream of water for washing sidewalks or other surfaces. A washer type nozzle may need to be able to deliver various pressures and amounts of water depending upon the requirements of the situation at hand. Some nozzles are configured to provide a continuous delivery of material through the nozzle, while others are configured to be adjustable from an open position, where material flows out of the nozzle, to a closed position, where material is prevented from leaving through the nozzle.

One common configuration of a nozzle provides an inner portion and an outer portion moveably interconnected by a threaded means that allows the outer portion of the nozzle to twist about the inner portion. These two portions are generally configured so that when the threaded means are engaged, the outer portion is moveable from a position where the inner portion and the outer portion are in a form of compressive engagement, or to a position where this compressive engagement is relaxed. In most cases, when the inner portion and the outer portion are positioned in compressive engagement, material cannot leave the nozzle. As this compressive engagement is relaxed, the nozzle begins to open and material is then able to pass out of the nozzle. Depending upon the configuration and structure of the portions of the nozzle, the patterns, amounts, velocities, and pressures of the liquid leaving the nozzle can vary.

In many applications, twisting or adjusting the nozzle away from the closed position generally functions to increase the amount of material flowing out of the nozzle. Depending upon the specific configuration of the nozzle, this adjustment may decrease the amount of spray from the nozzle and increase the amount of liquid that flows directly out of the nozzle in a stream of flow. This opening movement will generally stop at a position where a maximum amount of flow out of the nozzle will occur. In these same types of embodiments, twisting the outer portion of the nozzle in a manner that compresses the inner and outer portions of the nozzle will cause the direct flow from the nozzle to be decreased and the spray pattern to be increased. As this compressive movement continues, the inner and outer portions of the nozzle will generally engage and compress. As this compression occurs, the flow of liquid through the nozzle will be reduced and eventually shut off.

While this type of nozzle is useful in many applications, it also has some distinct disadvantages. First, because only one closed position exists, several turns of the outer portion of the nozzle are required to adjust the flow of the liquid and to turn the nozzle off and on. This structure also requires that to adjust the delivery of liquid out of the nozzle, the outer portion must be twisted or otherwise adjusted through all of the various dispersion patterns until arriving at a position where the nozzle is closed. Some of these nozzles also have a tendency to leak, provide irregular dispersal patterns, and may be awkward and/or difficult to use.

Therefore, it is an object of this invention to provide an adjustable nozzle, which allows for flow of liquid through the nozzle to be stopped at two different nozzle positions. It is also an object of this invention to provide a nozzle, which opens and closes by turning a portion of the nozzle in a clockwise or counterclockwise direction. It is a further object of the invention to provide a nozzle with increased ease of use.

Additional objects, advantages and novel features of this invention will be set forth in part in the description as follows and in part will become apparent to those skilled in the art upon examination of the following, or may be learned by practice of the invention. The objects and advantages of the invention are to be realized and obtained by the means of the instrumentalities and combinations particularly pointed out in the appended claims.

SUMMARY OF THE INVENTION

The present invention is a dual closure nozzle for use with a hose carrying a liquid under pressure. The nozzle is configured so that the nozzle can be moved from a first closed position through a variety of open positions to a second closed position. In one embodiment of the invention, the dual closure nozzle is made up of an outer sleeve threadedly connected around an inner delivery conduit. The outer sleeve has an opening at a receiving end for receiving the inner conduit and a discharge opening at a second end for allowing discharge of a fluid material therefrom. A bore extends from the receiving end to the discharge end and is configured to receive an inner conduit therein. Within the outer sleeve, a first sealing race and a second sealing race circumvolve the bore. The first sealing race is disposed within the bore closer to the receiving end and the second sealing race is disposed closer to the discharge end of the bore.

The inner conduit is configured for insertion within the receiving end of the outer sleeve, and extends within the bore. The inner conduit has an inlet opening configured for the passage of fluid material from an external source such as a garden hose into the inner sleeve and at least one outlet for the passage of the fluid material out from the inner conduit and into the outer sleeve. A first sealing means is located between the outer sleeve and the inner conduit and is configured to prevent the passage of fluid material out from the outer sleeve through the opening at the discharge end. A second sealing means is also located between the inner conduit and the outer sleeve and is configured to prevent the passage of fluid material out from the outer sleeve through the opening at the receiving end. The inner conduit and the outer conduit are held together by a threaded connection means which allows the outer sleeve to be displaced longitudinally by twisting the outer sleeve about the inner conduit.

In one embodiment of the invention, the nozzle is configured so that when the outer sleeve and inner conduit are configured in a first closed position, the first sealing means is in fluid tight engagement with the second sealing race. Twisting the outer sleeve about the inner conduit causes the outer sleeve to move longitudinally along the inner conduit. As this outer sleeve moves longitudinally along the inner conduit, the device moves from this first closed position through a variety of open positions to a second closed position. At this second closed position, the first sealing means is in fluid tight engagement with the first sealing race.

In another embodiment of the invention, the inner conduit has an end cap connected to an end of the conduit located distally from the inlet opening. The end cap is configured for fluid tight engagement with the second sealing race. In this embodiment, when the outer sleeve is rotated, the threaded portions move the outer sleeve longitudinally from a first closed position wherein the first sealing means is in fluid tight engagement with the second sealing race through a variety of open positions to a second closed position wherein the end cap is positioned in fluid tight engagement with the second sealing race.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
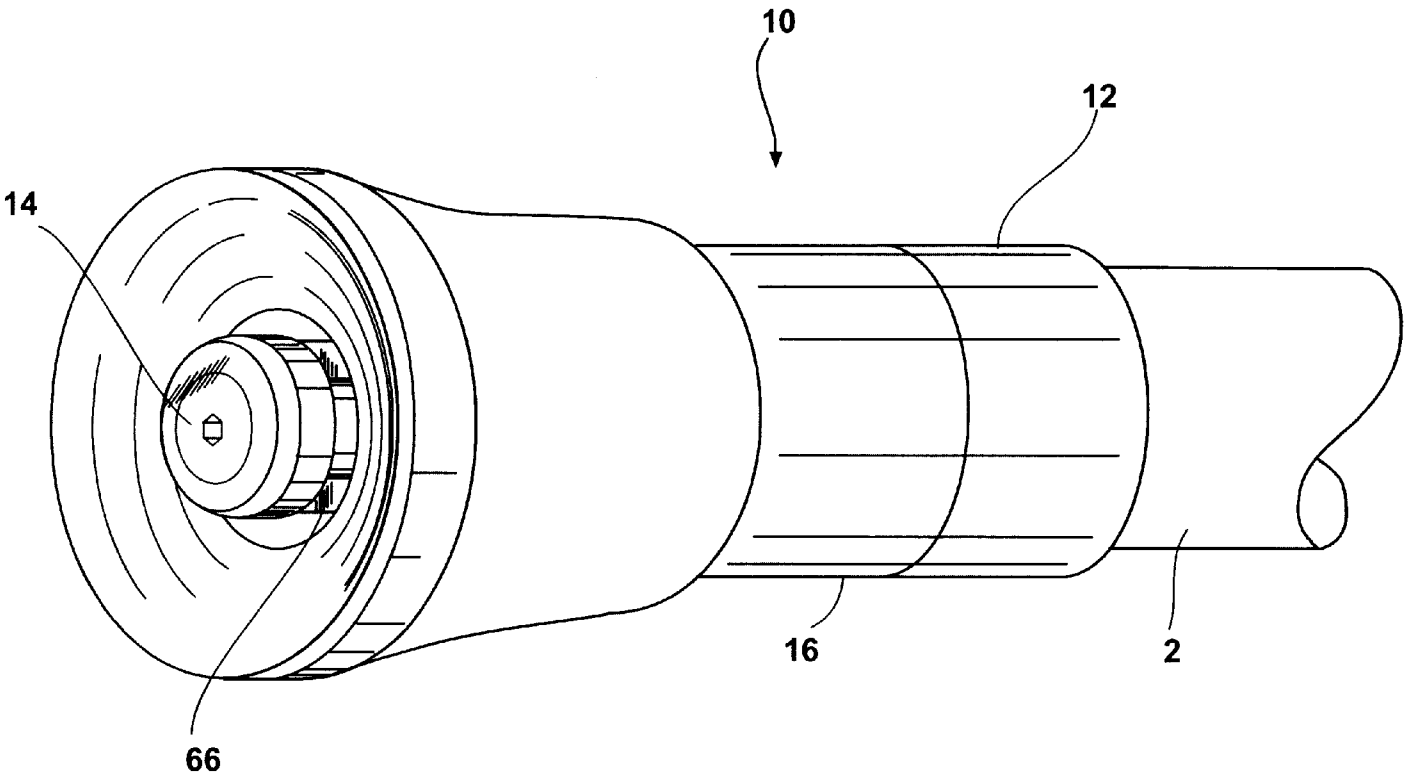
FIG. 1 is a perspective view of a preferred first embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a dual closure nozzle that provides regulation of the flow of a liquid out of a hose. The dual closure nozzle provides two means for stopping the flow of the liquid through the nozzle. This enables the party utilizing the nozzle to twist the nozzle in one direction and in so doing change the flow of the liquid through the nozzle from a closed position, where no liquid leaves the nozzle, to a variety of open positions, to another closed position. While in this embodiment the invention is described in use with a garden type hose that carries water under pressure, it is to be distinctly understood that the features of the invention are not limited to this use, but may be used in any application wherein a nozzle with the disclosed capabilities is desired. Therefore, this disclosure should be seen as illustrative in nature and not as restrictive.

Referring now to FIGS. 1–6, a first embodiment of the present invention is shown. FIG. 1 is a perspective view of the first embodiment of the present invention. The dual closure nozzle 10 comprises an inner delivery conduit 12, moveably attached within an outer sleeve 16 by a connection means (shown in FIG. 2). In this embodiment, the inner conduit 12 has a portion adapted for connection with a hose 2, an end cap 14, and a series of fins 66 which assist to direct the flow and dispersal pattern of the fluid upon discharge from the outer sleeve 16.

Figure 2:
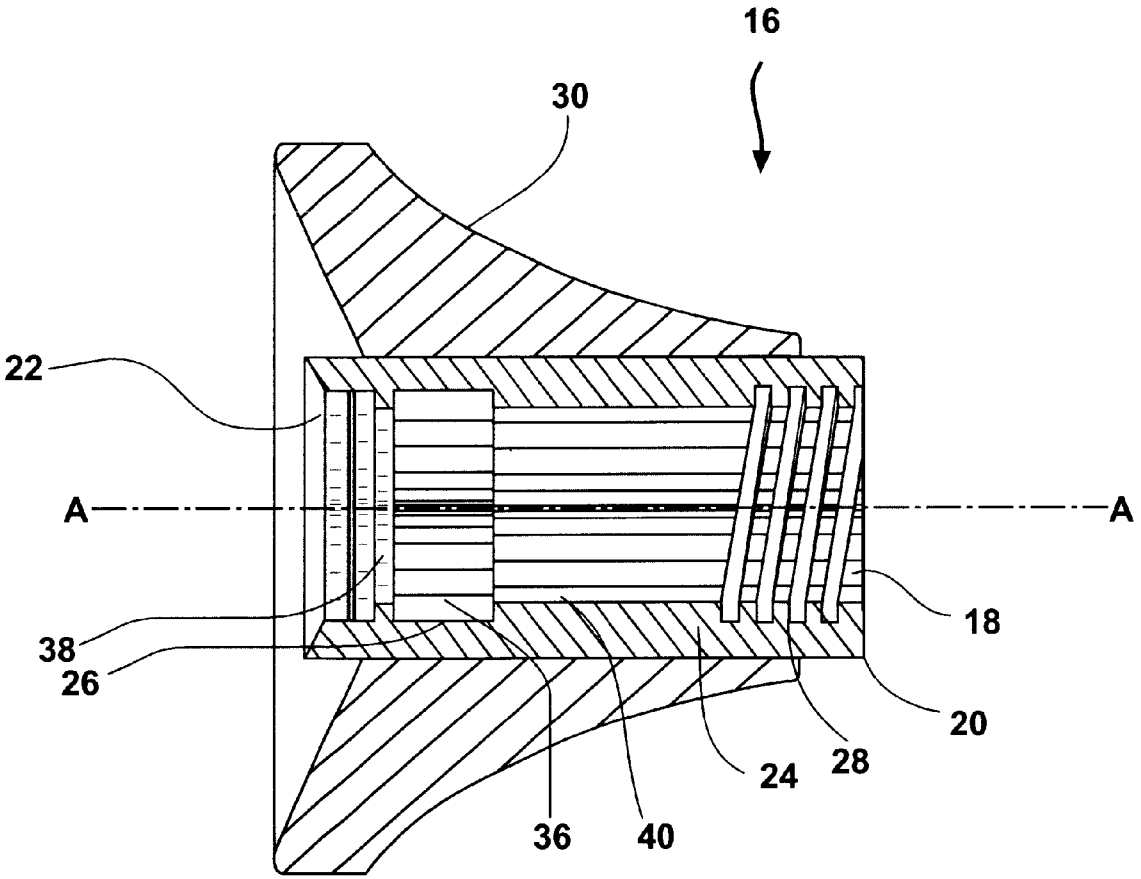
FIG. 2 is a detailed cross-sectional side view of the outer sleeve portion of the present invention.

Referring now to FIG. 2, a detailed cross-sectional side view of the outer sleeve 16 is shown. The outer sleeve 16 has a handle portion 30 configured for manual grasping. In this embodiment, the handle portion 30 is a generally frusto-conically shaped covering made of a graspable, compressive rubber type material. This handle portion 30 surrounds the outer sleeve 16 and allows the user to more easily grasp and rotate the outer sleeve 16 about the inner conduit 12. While the handle 30 in this embodiment has the illustrated configuration, it is to be understood that any shape, configuration or material may be used to bring about this desired result.

The outer sleeve 16 defines a bore 18 extending from an open first end 20 to an open second end 22 along an axis A—A. The open first end 20 and the bore 18 are configured to receive the inner conduit 12 therein. The open second end 22 forms a discharge opening which is configured to allow the passage of the fluid material therethrough.

The receiving end 20 of the outer sleeve 16 has a connection means 28 for connecting the outer sleeve 16 with the inner conduit 12. In this embodiment, the connection means 28 is a set of compatibly threaded circumvolving grooves that are located within the bore and are configured to correspond with a set of correspondingly configured threaded ridges located upon the inner conduit (shown in FIG. 3). The combination of grooves and ridges allows the outer sleeve 16 to be held in a desired position and orientation with regard to the inner conduit 12. This also allows the outer sleeve 16 to be selectively longitudinally displaced in relation to the position of the inner conduit 12. While in this embodiment the connection means 28 is a pair of correspondingly configured threaded portions, this is not the only connection means envisioned by this invention. It is to be distinctly understood that any connection means may be used which would enable the outer sleeve 16 and the inner conduit 12 to be moveably connected, and would allow the outer sleeve 16 and the inner sleeve 12 to be held in a variety of desired longitudinal positions with regard to each other.

The outer sleeve 16 has a first circumvolving sealing race 24 spatially disposed within the bore at a desired distance from a second circumvolving sealing race 26. Both the first and the second circumvolving races 24, 26 are configured for fluid tight engagement with a sealing means (shown in FIG. 3). The sealing races 24, 26 define between them a flow chamber 40 within the bore 18. Each of these sealing races 24, 26 circumvolve the inner portions of the bore 18 and are configured to allow the inner conduit 12 to pass therethrough. Each of the first and second sealing races 24, 26 are also configured for fluid tight sealing engagement with a sealing means (shown in FIG. 3). In this embodiment, the second side 38 of the second sealing race 26 is configured for compressive leak tight engagement between the second sealing race 26 and a first side 70 of an end cap 14 (shown in FIG. 3).

Figure 3:
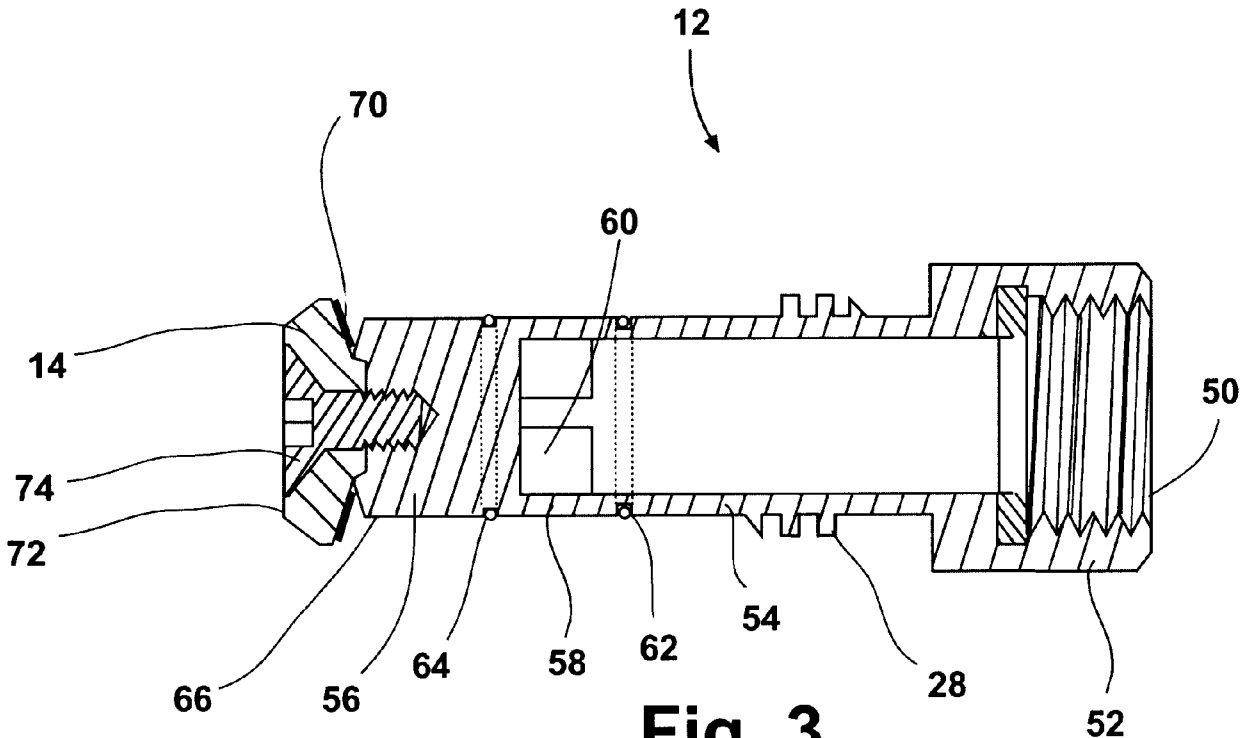
FIG. 3 is a detailed cross-sectional side view of the inner conduit portion of the present invention.

Referring now to FIG. 3, a detailed, cross-sectional side view of the inner delivery conduit 12 is shown. The inner delivery conduit 12 has an open first end 50 with an attachment means 52 configured for connection to a source of pressurized liquid, such as a watering hose. While in this embodiment the inlet 50 that allows liquid to enter into the inner conduit is located at the first end 50 of the inner conduit 12, it is to be distinctly understood that such a location is merely illustrative and is not limiting. The inlet 50 for allowing fluid to enter into the chamber need not be located at an end but may be located in nearly any position along the inner conduit 12. This described embodiment is merely an illustrative embodiment of the invention.

In this embodiment, the inlet 50 further comprises an attachment means 52. This attachment means 52 has a threaded portion with a sealing ring which prevents leakage from the connection between the liquid source and the inner conduit 12. The configuration of the attachment means 52 is dependent upon the characteristics of the source to which the nozzle 10 is to be connected. Therefore, while in this embodiment a threaded means is shown, it is to be distinctly understood that any configuration may be used which achieves the desired result of connecting the inner conduit 12 to a source of a liquid under pressure such as a hose.

The inner delivery conduit 12 extends from the open first end 50 along a hollow body 54 to a closed second end 56. The hollow body 54 has a portion 58 dimensioned for insertion within the bore 18 of the outer sleeve 16. The hollow body 54 insertion portion 58 has at least one outlet opening 60 therein. In this embodiment, four outlets 60 are located near the second end 56. These outlets 60 are configured to allow passage of the material out of the hollow body portion 54 of the inner conduit. In this embodiment, the inner conduit 12 is configured so that when combined with the outer sleeve 16, the outlets 60 of the inner conduit 12 are located generally within the expansion chamber 40 of the outer sleeve 16.

At least two sealing means 62, 64 are located between the outer sleeve 16 and the inner sleeve 12. In this embodiment, these sealing means are rubber O-rings 62, 64 circumvolving the hollow body 54. The first sealing means 62 circumscribes the hollow body 54 in a location along the hollow body 54 between the first end of the hollow body 50 and the outlets 60. The second O-ring 64 circumscribes the hollow body 54 at a location between outlets 60 and the second closed end 56 of the inner conduit. Each of the sealing means 62, 64 is configured for compressive leak tight engagement with the sealing races 24, 26 of the outer sleeve 16. While in this embodiment the sealing means 62, 64 are rubber O-rings, it is to be understood that any sealing means which is capable of providing a leak tight seal between the inner conduit 12 and the outer sleeve 16 may be used.

The closed second end 56 of the inner conduit 12 has a set of fins 66 THAT assist in directing the flow of water out of the nozzle 10. The closed end 56 of the inner conduit is also connected to an end cap 14. The end cap 14 has a first side 70 and a second side 72. The first side 70 is configured to form a compressive leak tight seal against the second side 38 of the second sealing race 26 when brought into compressive engagement against this side.

In this embodiment, the end cap 14 is connected to the closed end 56 of the inner conduit 12 by an end cap connecting means 74. The connecting means 74 for attaching the end cap 14 to the second end 56 is, in this embodiment, a threaded bolt with a flat head. While in this embodiment this means is a threaded bolt with a flat head, it is to be distinctly understood that any means may be used to hold the end cap 14 against the second end 56 of the inner conduit 12.

Figure 4:
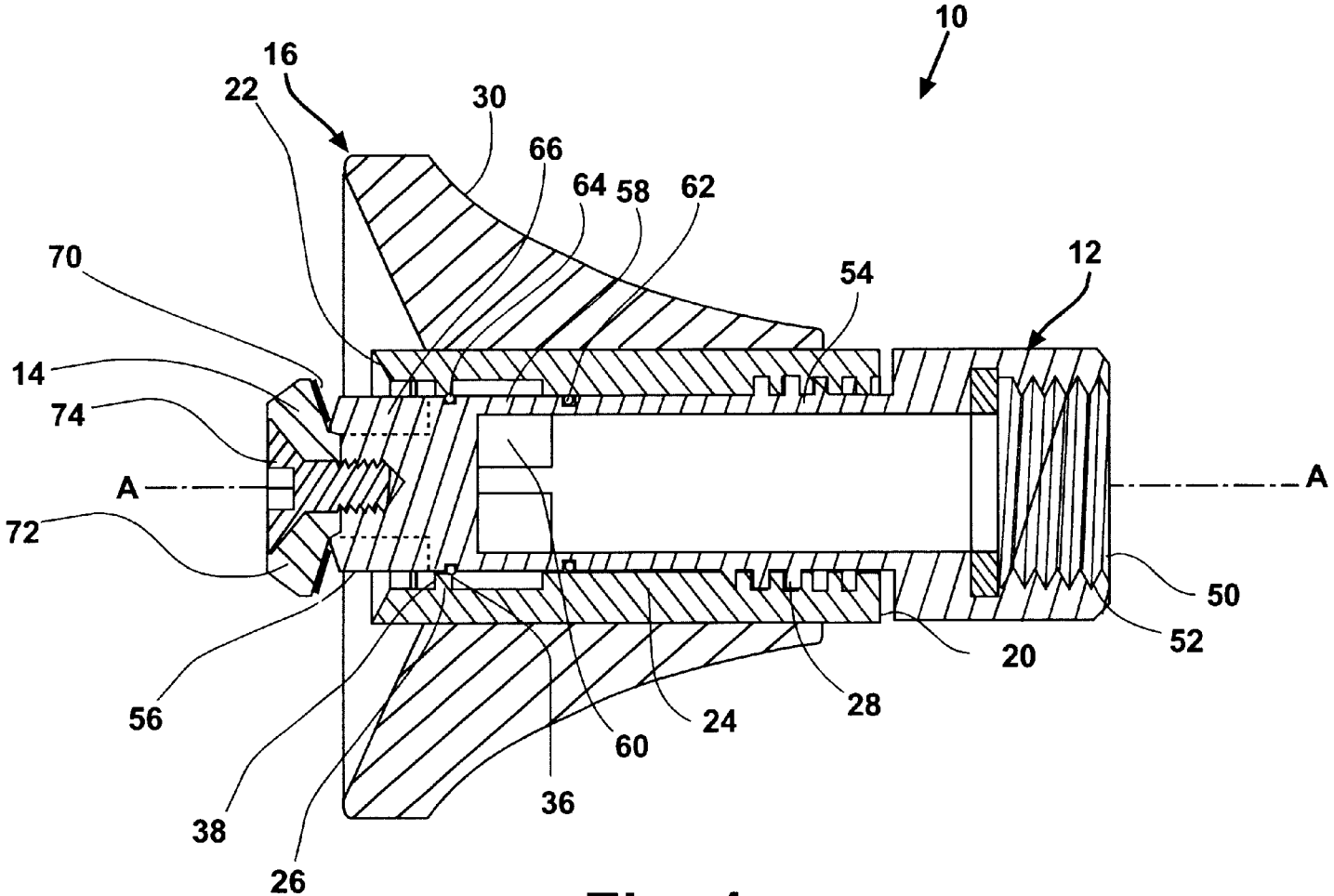
FIG. 4 is a detailed cross-sectional side view of the embodiments of FIGS. 2 and 3 when the device is in a first closed position.

Referring now to FIG. 4, a detailed cross-sectional view of the nozzle 10 shown in FIG. 1 is shown. In this Figure, the inner conduit 12 and the outer sleeve 16 are arranged in a first closed position. In this position, the hollow body portion 54 of the inner conduit 12 is located within the bore 18 of the outer sleeve 16 and the outer sleeve 16 and the inner conduit 12 are threadedly interconnected by the connection means 28. The inner conduit 12 is positioned so that the first sealing means 62 is in a compressive leak tight engagement against the first sealing race 24. This engagement prevents back flow of liquid material towards the receiving end 20 of the outer sleeve 16. The second sealing means 64 is placed in a compressive leak tight engagement against the second sealing race 26 thus preventing forward movement of material out of the discharge opening 22 of the outer sleeve 16. In this preferred embodiment, this second O-ring 64 is in a compressive engagement against the second sealing race 26. In this first closed position, liquids from the source enter the inner conduit 12 from the open first end 50, pass along through the hollow body 54, and are pushed out of the outlets 60 and into the outer sleeve 16. Upon leaving the outlets 60, the liquid is prevented from flowing out of the nozzle 10 by the compressive leak tight seals provided by the combinations of the sealing means 62, 64 and the sealing races 24, 26.

Figure 5:
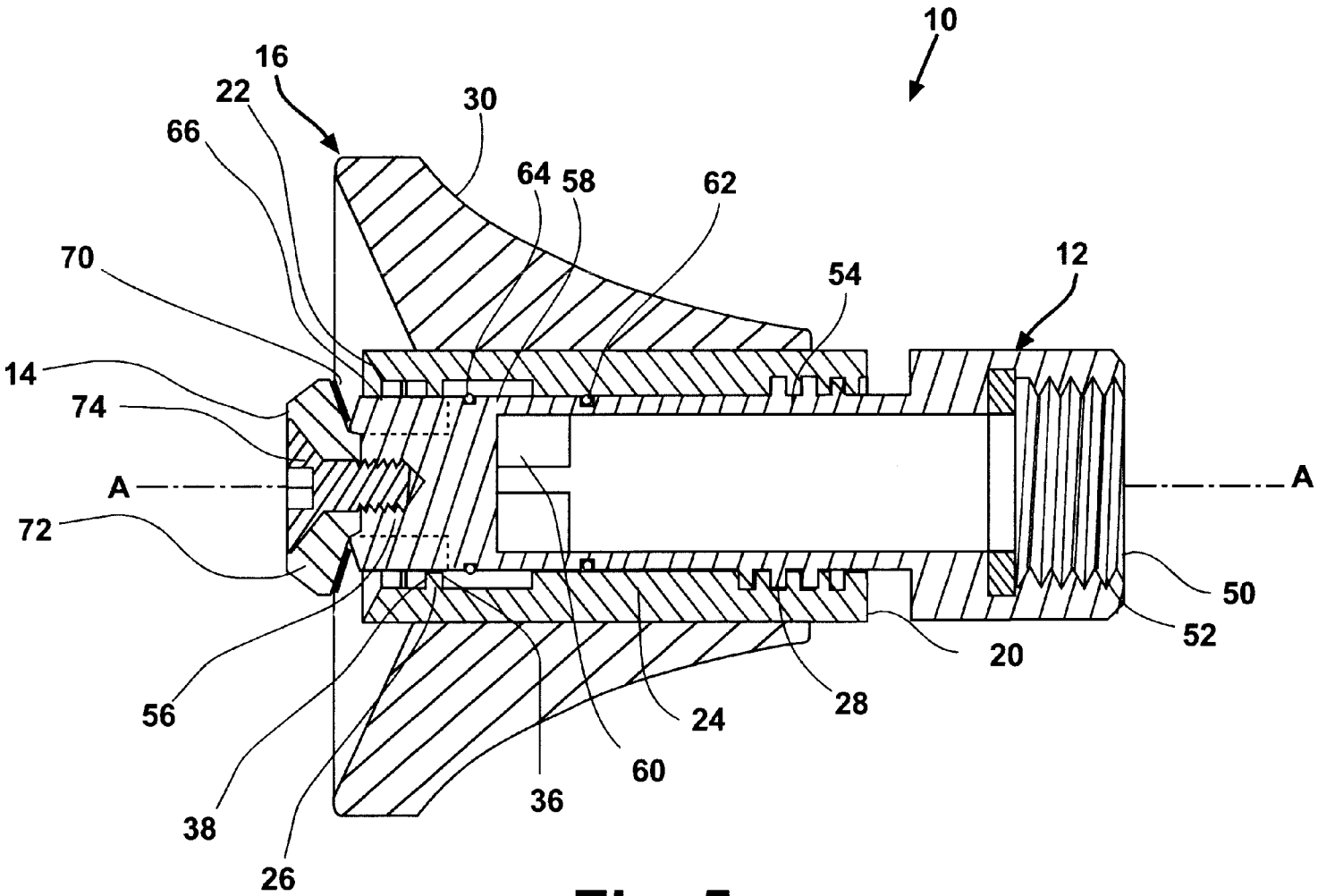
FIG. 5 is a detailed cross-sectional side view of the embodiments of FIGS. 2 and 3 when the device is in an open position between a first closed position and a second closed position.

Referring now to FIG. 5, the embodiment of the invention shown in FIG. 4 is shown in an open position wherein the nozzle is partially open allowing material to flow through said nozzle 10. In this open position, the second sealing means 64 is no longer in a compressive leak tight engagement against the second sealing race 26. In this open position, material enters the hollow body 54 and is pushed out of the outlets 60. The seal provided by the first sealing means 62 and the first sealing race 24 prevents the back flow of material toward the first end 20 of the sleeve 16. There is no seal preventing flow of material out of the second end 22 of the sleeve 16 therefore material exits this end 22. The direction and formation of the discharge from the second end 22 is dependent upon a variety of factors including the size of the opening through which the material passes as it leaves the second end 22 of the outer sleeve 16. The dispersion pattern of the material is further affected by the shape, number and presence of fins 66 located upon the hollow member 54.

Figure 6:
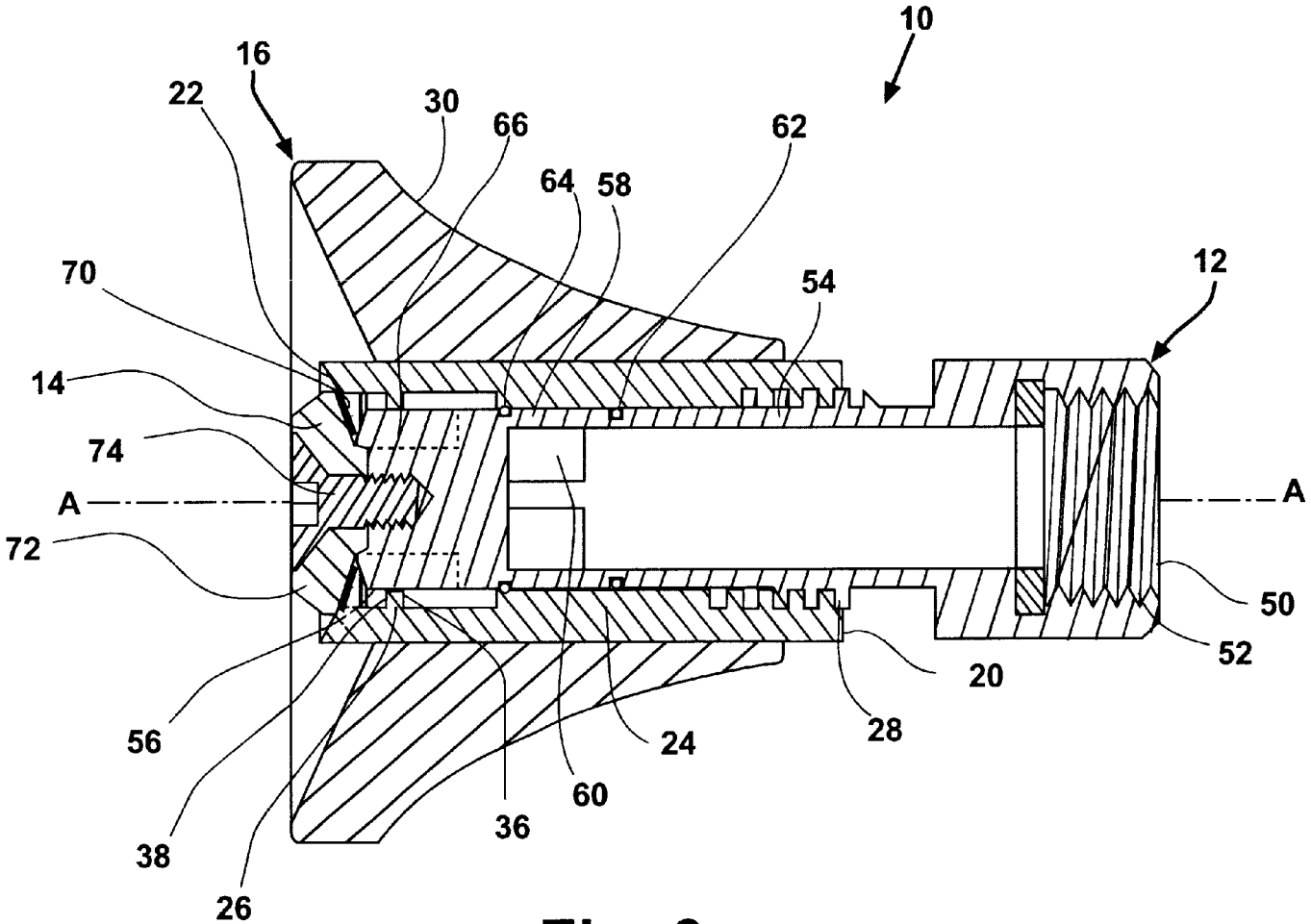
FIG. 6 is a detailed cross-sectional side view of the embodiments of FIGS. 2 and 3 when the device is in a second closed position.

Referring now to FIG. 6, the embodiment of the invention shown in FIGS. 4 and 5 is shown in a second closed position. In this configuration, the inner conduit 12 is positioned so that the first sealing means 62 is in a compressive leak tight engagement against the first sealing race 24. This engagement prevents material from flowing back toward the receiving aperture 20 of the outer sleeve 20. The first side 70 of the end cap 14 is in a compressive leak tight engagement against the second sealing race 26. This prevents forward movement of material out of the second end 22 of the outer sleeve 16.

In this second closed position, material enters the hollow body 54 and is pushed out of the outlets 60. However, the material does not leave the nozzle 10 because of the compressive leak tight engagement provided by the first sealing means 62, the first sealing race 24, the first surface 70 of the end cap 14, and the second sealing race 26. In some embodiments, the first surface 70 of the end cap 14 may have a coating or covering THAT increases its ability to form a compressible leak tight engagement against the outer sleeve.

In use, a hose is attached to the first end of the inner conduit 50 by cooperation with the threaded adapter means 52. As water is forced into the first end 50 of the inner conduit 12, the water passes into the hollow body 54. The water then travels through the hollow body 54 and exits the inner conduit 12 through the outlets 60. Upon exiting the inner conduit 12, the water impacts the bore 18 of the outer sleeve 18. A seal formed by the first sealing means 62 and the first sealing race 24 prevents back flow of the water out of the outer sleeve 16 through the receiving aperture 20. The passage of water out of the discharge opening 22 is dependent upon the positioning of the inner conduit 12, the outer sleeve 16 and the end cap 14.

In the first closed position, shown in FIG. 4, the second sealing means 64 is in a leak tight engagement against the second sealing race 26 of the outer sleeve 16. This leak tight engagement between the second sealing means and the second sealing race forms a seal that, prevents the flow of water out through the discharge end 22 of the outer sleeve. This seal together with the seal formed by the first sealing means 62, and the first sealing race 24, prevents the flow of water out of the nozzle. The nozzle is thus shut off.

As the inner conduit 12 is longitudinally moved within the outer sleeve 16 by the rotation of the threaded connection means 28, the compressive engagement between the second sealing means 64 and the second sealing race 26 is relaxed. However, the first sealing race 24 maintains a seal with the first sealing means 62. The relaxing of the seal toward the discharge opening 22 opens the nozzle and allows water to exit therethrough. This open position is shown in FIG. 5.

The amount, pressure, and velocity of the water that leaves the nozzle 20 is dependent to a certain extent upon the size of the opening through which the water will pass. When the device 20 is only partially opened, a small opening exists through which water will pass. As a general rule, this results in less water leaving the nozzle 20 over a designated period of time and a finer spray pattern than when the device is more fully opened. As a general rule, the more open the nozzle 20 is, the more water can leave the nozzle 20 and the less fine the spray pattern would be. In addition to the size of the opening through which the water will pass, the spray characteristics are affected by a variety of devices such as the fins 66 shown in this embodiment.

In this embodiment, the size of the opening through which the water leaves the nozzle 20 is increased and decreased as the inner conduit 12 and the outer sleeve 16 are adjusted between the first and second closed positions. In as much as the largest opening results at the greatest distance from the closed positions, the position of maximum flow will occur when inner conduit 12 and the outer sleeve 16 are located at a position generally equidistant between the first and second closed positions. As the relationship between the inner conduit 12 and the outer sleeve 16 is adjusted, the characteristics of the discharge can be varied. For example, creating a smaller end cap 14 and enlarging the dimensions of the second sealing race 26 would provide for a more direct flow type discharge than the nozzle shown in the present embodiment. Likewise, placing a larger end cap 14 on the second end of the inner portion and varying the dimensions of the outer sleeve second end opening 22 would allow for a wider and greater spray opening.

When the first side 70 of the end cap 14 is compressively engaged against the when side 38 of the second sealing race 26, the flow of water out of the discharge opening of the outer sleeve is also stopped. The existence of two spaced closed positions allows the nozzle 10 to either be opened or closed by turning the outer sleeve 16 in either of two directions in relation to the inner sleeve 12. In this embodiment, this allows the nozzle 10 to be either opened or closed by turning the outer sleeve 16 in either a clockwise or counterclockwise direction.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A dual closure nozzle comprising:

an outer sleeve configured for receiving an inner conduit in longitudinally moveable interconnection, said outer sleeve having a receiving aperture configured for receiving said inner conduit and at least one discharge opening configured to allow passage of a fluid material out from said outer sleeve, said outer sleeve further being longitudinally displaceable about said inner conduit from a first closed position through an intermediate open position to a second closed position;

said inner conduit configured for positioning within said outer sleeve, said inner conduit having an inlet opening configured for the passage of fluid material from an external source into said inner sleeve and at least one outlet opening configured for the passage of fluid material out from said inner conduit and into said outer sleeve;

first sealing means disposed between said outer sleeve and said inner conduit and configured to prevent the passage of fluid material out from said outer sleeve and through said discharge opening when said outer sleeve is rotated about said inner conduit to said first closed position and to permit the passage of fluid material out from said outer sleeve and through said discharge opening when said outer sleeve is rotated about said inner conduit to said intermediate open position; and second sealing means disposed between said outer sleeve and said inner conduit and configured to prevent the passage of fluid material out from said outer sleeve and through said discharge opening when said outer sleeve is rotated about said inner conduit to said second closed position and to permit the passage of fluid material out from said outer sleeve and through said discharge opening when said outer sleeve is rotated about said inner conduit to said intermediate open position.

2. The dual closure nozzle of claim 1 further comprising a third sealing means disposed between said outer sleeve and said inner conduit, said third sealing means configured to prevent flow of fluid material out of said outer sleeve through said receiving aperture.

3. The dual closure nozzle of claim 2 further comprising an adjustable connection means configured for adjusting said outer sleeve to a desired position and also configured for maintaining said outer sleeve in said desired position.

4. The dual closure nozzle of claim 3 wherein said adjustable connection means is a threaded connection which interconnects said inner conduit and said outer sleeve.

5. A dual closure nozzle comprising:

an outer sleeve having a central longitudinal bore for receiving in longitudinally movable interconnection an inner conduit, said outer sleeve having, in sequence, a receiving aperture for receiving said inner conduit, a fluid material flow chamber defined within said central bore and at least one discharge opening configured to allow passage of a fluid material out from said fluid material flow chamber of said outer sleeve, said outer sleeve further being longitudinally displaceable along said inner conduit from a first closed position through an intermediate open position to a second closed position;

said inner conduit configured for positioning within said outer sleeve, said inner conduit having an inlet opening configured for the passage of fluid material from an external source into said inner sleeve and at least one outlet opening configured for the passage of fluid material out from said inner conduit and into said fluid flow chamber of said outer sleeve; and sealing means disposed between said outer sleeve and said inner conduit, said sealing means configured to prevent the passage of fluid material out from said outer sleeve and through said discharge opening when said outer sleeve is longitudinally displaced in said first closed position, to prevent the passage of fluid material out of said outer sleeve when said outer sleeve is longitudinally displaced in said second closed position, and to permit the passage of fluid material out from said outer sleeve and through said discharge opening when said outer sleeve is longitudinally disposed in said intermediate position.

6. The dual closure nozzle of claim 5 wherein said sealing means further comprises:

a first sealing race disposed within said central bore of the outer sleeve between said receiving aperture and said fluid material flow chamber;

a second sealing race disposed within said central bore between said fluid material flow chamber and said discharge outlet; and a sealing ring circumvolving said inner conduit in a position between said outlet opening of said inner conduit and said discharge opening of said outer sleeve, said sealing ring configured for fluid tight engagement with said first sealing race when said outer sleeve is positioned at said first closed position, and for fluid tight engagement with said second sealing race when said outer sleeve is positioned at said second closed position, said sealing ring also configured to allow passage of fluid material out of said discharge opening when said outer sleeve is positioned at said intermediate position.

7. The dual closure nozzle of claim 5 further comprising a second sealing ring circumvolving said inner conduit in a position between said outlet opening of said inner conduit and said receiving aperture of said outer sleeve, said second sealing ring configured for fluid tight engagement with said first sealing race.

8. The dual closure nozzle of claim 7 further comprising an end cap attached to said inner conduit, said end cap configured for fluid tight engagement with said second sealing race when said nozzle is in a first closed position.

9. The dual closure nozzle of claim 8 further comprising means for connecting said inner conduit within said outer sleeve.

10. The dual closure nozzle of claim 9 wherein said means for connecting said inner conduit within said outer sleeve comprises a ridge circumvolvingly advancing about said inner conduit, said ridge configured for connection with corresponding grooves located within said central bore of said outer sleeve.

11. A dual closure nozzle comprising:

an outer sleeve having a central longitudinal bore for receiving in longitudinally movable interconnection an inner conduit, said outer sleeve having, in sequence, a receiving aperture for receiving said inner conduit, a first sealing race, a fluid material flow chamber defined within said central bore, a second sealing race, and a discharge opening configured to allow passage of a fluid material out from said fluid material flow chamber, said outer sleeve further being longitudinally displaceable along said inner conduit from a first closed position through a series of intermediate open positions to a second closed position;

said inner conduit configured for positioning within said outer sleeve, said inner conduit having in series an inlet opening configured for the passage of fluid material from an external source into said inner sleeve, a first sealing means, at least one outlet opening configured for the passage of fluid material out from said inner conduit and into said fluid flow chamber of said outer sleeve, a second sealing means and a second end connected to an end cap;

said end cap having a surface configured for fluid tight engagement with said second sealing race when said outer sleeve and inner conduit are in a first closed position;

said first sealing means disposed between said outer sleeve and said inner conduit at a position between said fluid flow chamber and said receiving aperture, said first sealing means configured to prevent the passage of fluid material from out of said outer sleeve through said receiving aperture;

said second sealing means disposed between said outer sleeve and said inner conduit at a position between said fluid flow chamber and said discharge opening, said second sealing means configured to prevent the passage of fluid material from out of said outer sleeve through said discharge opening when said outer sleeve is longitudinally displaced in relation to said inner conduit in a second closed position, said second sealing means also configured to allow passage of fluid material from out of said outer sleeve and through said discharge opening when said outer sleeve is longitudinally disposed in relation to said inner conduit in an intermediate position between said first closed position and said second closed position.

12. The dual closure nozzle of claim 11 wherein said sealing means are O-rings configured for placement about said inner conduit.

* * * * *